US005928003A

United States Patent [19]

Kajinuma

[11] Patent Number: 5,928,003

[45] Date of Patent: Jul. 27, 1999

[54] ELECTRICAL CONNECTOR FOR PRINTED CIRCUIT BOARDS

[75] Inventor: Shuji Kajinuma, Kanagawa, Japan

[73] Assignee: The Whitaker Corporation, Wilmington, Del.

[21] Appl. No.: 08/882,433

[22] Filed: Jun. 25, 1997

[30] Foreign Application Priority Data

Jun. 27, 1996 [JP] Japan ..... 8-186683

[51] Int. Cl.[6] ..... H01R 9/09

[52] U.S. Cl. ..... 439/74; 439/248

[58] Field of Search ..... 439/74, 83, 247, 439/248, 570, 660

[56] References Cited

U.S. PATENT DOCUMENTS 4,583,813 4/1986 Yamada ..... 439/345
5,201,663 4/1993 Kikuchi et al. ..... 439/83
5,224,866 7/1993 Nakamura et al. ..... 439/81
5,556,286 9/1996 Ikesugi et al. ..... 439/74

FOREIGN PATENT DOCUMENTS

0144128 A2 6/1985 European Pat. Off. .

*Primary Examiner*—Steven L. Stephan
*Assistant Examiner*—Barry M. L. Standig
*Attorney, Agent, or Firm*—Anton P. Ness

[57] ABSTRACT

Contacts fabricated from a thin metal sheet by stamping in the form of a lead frame are used as U-shaped contact assemblies 30 which are straddled over and secured to side walls 22, 23 of the insulating housing 20 or are molded as an integral part thereof. Due to the fact that a gap G is formed between the outer surface 36 of contacts 31 of the contact assembly 30 and outside surface of side walls 22, 23 of the insulating housing 20, the connector 10 can move in a lateral direction relative to the printed circuit board 50.

12 Claims, 2 Drawing Sheets

ELECTRICAL CONNECTOR FOR PRINTED CIRCUIT BOARDS

FIELD OF THE INVENTION

This invention relates to electrical connectors and more particularly to connectors mounted on printed circuit boards.

BACKGROUND OF THE INVENTION

Electrical connectors are devices providing for connection between conducting objects, and a number of devices of various configurations and sizes for this purpose were offered in the art. One type of electrical connector is designed specifically for the mounting on printed circuit board by soldering. Such connectors usually consist of a plug (male) connector and a receptacle (female) connector, and they interconnect associated circuits of two parallel printed circuit boards. With a general trend toward reduction of electronic devices in size, the space between printed circuit boards is being reduced at a fast pace, and in many cases it can be as little as a few millimeters.

Example of connectors for printed circuit boards can be found in U.S. Pat. No. 5,224,866; Japanese Utility Model Disclosure Hei 3 (1991)-126389 and Japanese Patent Disclosure Hei 4 (1992)-43579. Such conventional connectors for printed circuit boards have a number of flat contacts intended for the connection by means of surface mounting technology (SMT) to contact pads of two parallel printed circuit boards. Contacts of a connector mounted on one of the printed circuit boards are designed so that they have relatively long effective length in order to be able to provide sufficient contact pressure (normal force) developed by the spring-loaded design of the contacts against contacts of the mating connector. Such an arrangement makes it possible to implement connectors for printed circuit boards having a high density of contacts (up to 0.5 mm pitch).

However, elasticity of the contacts made by stamping from a resilient metal sheet is rather limited. It is especially difficult to achieve sufficient elasticity of contacts in portable communications devices such as personal handy phones (PHS) in which the gap between boards can be as little as a few millimeters while the component density is very high. In addition, in the event of misalignment between two printed circuit boards, when the connectors themselves are not exactly aligned with each other, an attempt to forcibly join connectors can result in damage of deformation of the connectors or their contacts.

A method to handle misalignment between two boards is offered in U.S. Pat. No. 5,501,663 or in Japanese Patent Disclosure No. Hei 4 (1992)-370677. This method consists in making at least one housing of two sections allowing for certain flexibility due to contacts made in a zigzag configuration, thus increasing their effective length. However, in order to achieve the flexibility, it is necessary to increase physical dimensions of the connector, thus diminishing its suitability for small-size high-density applications.

Another problem observed in high-density electrical connectors is related to the edges of the contacts that are fabricated, as mentioned above, by stamping from resilient metal sheet material and that become contacting surfaces with the mating contacts. The point is that the smoothness of the edge surfaces obtained by shearing is inferior to the face surface produced by rolling, thus making it difficult to obtain stable and reliable electrical connections.

In order to solve the problem related to poor quality of the contacting surfaces, it was offered to cut contacts from a very thin metal sheet, bend them to a U-shaped configuration and place them over and around posts of the insulating housing so that the rolled surface becomes the contacting surface (Japanese Patent Disclosure Hei 3 (1991)-45873). Another proposed solution concerned contacts consisting of two arms originating from a flat base that are twisted 90°, thus providing a relatively wide surface of contact (for example, see Japanese Patent Disclosure Hei 3 (1991) -70350).

However, solutions in which such contacts with rolled surfaces as the contacting surfaces are used can be offered only for relatively large connectors with a low or medium density of contacts (with a pitch over 1 mm), and can not be applied to small-size high-density connectors.

SUMMARY OF THE INVENTION

This invention concerns high reliability electrical connectors for printed circuit boards which are arranged a few millimeters apart in high density mounting applications which have sufficient flexibility to absorb slight misalignment between mating connectors.

This invention also has a purpose to make it possible to offer miniature connectors for printed circuit boards which can be manufactured in quantities at a relatively low cost.

An electrical connector for printed circuit boards according to the present invention has a plurality of contacts mounted in a housing each having a board-connecting section intended for the soldering to the printed board and a contact section intended for the forming of a connection with a contact of the mating connector. A characteristic feature thereof is that the contacts are formed from a U-shaped thin conductive metal sheet and arranged in such a manner that there is a gap between the outer surface of the housing and intermediate sections of the contacts, thus allowing the connector to move incrementally within certain limits due to such a configuration of the contacts.

Another characteristic feature of the electrical connector according to this invention is that the contacts are fixed by insulating strips located near both ends, and their middle section is bent in a U-shaped configuration. When they are mounted on the housing, they provide for a certain degree of movement relative to the printed circuit board.

In a preferred embodiment, the contacts are made from very thin metal sheet material (a thickness of about 0.05 mm) using stamping and other manufacturing techniques and arranged at a pitch of 0.5 mm. Contact surfaces of the sections forming the connections with mating contacts and the surfaces joined to the contact pads of the printed circuit board, are smooth rolled surfaces, which assures reliable connections. At the same time, due to the fact that the contacts are extremely thin, they can move within the space provided in the outer surface of the housing. Therefore, connectors can be joined together even if there is a shift-type or twist-type misalignment between two printed circuit boards.

Embodiments of the electrical connector will now be described by way of example with reference to the accompanying drawings.

Figure 1:
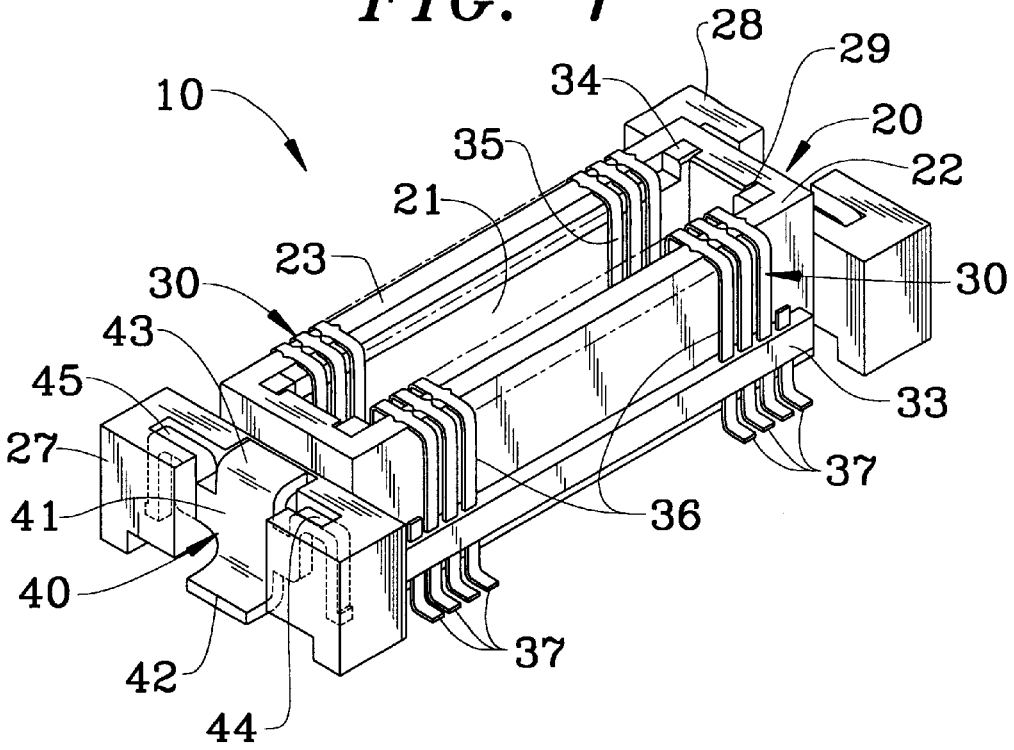
FIG. 1 is an isometric view of a preferred embodiment of electrical connector according to this invention.
Figure 3:
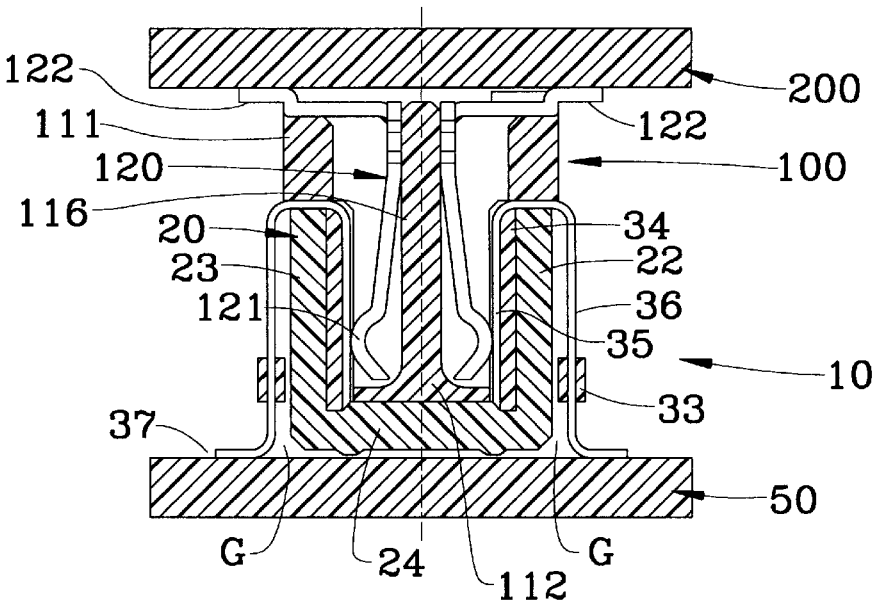
FIG. 3 is a cross section depicting the connectors of FIGS. 1 and 2 mounted to printed circuit boards and mated.

Electrical connector 10 of FIG. 1 consists of an insulating housing 20 and two rows of contact assemblies 30. A pair of metal fasteners 40 is for the attachment of the insulating housing 20 to a printed circuit board 50 (FIG. 3). Insulating housing 20 has an elongated rectangular configuration. In the center, cavity 21 is provided for the insertion of the complementary section of the mating connector 100 (FIG. 3). The housing has side walls 22, 23 located at both sides and a bottom 24. At both ends of the housing, end sections 27, 28 are provided with openings 25, 26 to accommodate fasteners 40.

Assemblies 30 of U-shaped contacts are secured in arrays in two rows at side walls 22, 23 along the long sides of the insulating housing 20. Contact assemblies 30 have contact sections 35 intended for the forming of connections with contacts of mating connector 100, that are located inside cavity 21 of insulating housing 20, and intermediate sections 36 that extend freely along the outer surfaces of side walls 22, 23 of the insulating housing. Free ends of intermediate sections 36 are bent outwardly at right angles coplanar with the board-mounting face of the housing to form board-connecting portions 37 that are soldered to contact pads of the board.

In the preferred embodiment, the contact assemblies are made of gold plated copper alloy of the thickness of 0.05 mm and are arranged at a pitch of 0.5 mm. It is a difficult task to fabricate contacts from extremely thin metal sheet material, arrange them at a uniform intervals and prevent them from shorting during subsequent handling.

Figure 4:
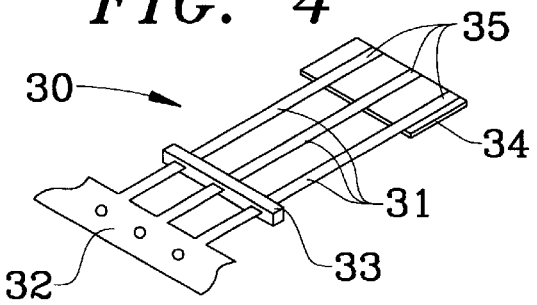
FIG. 4 is an isometric view explaining an assembly process of contacts of the electrical connector shown in FIG. 1.

Therefore, another specific feature of the preferred embodiment of this invention is that a number of contacts are arrayed in assemblies 30 in order to maintain the alignment of a plurality of highly elastic contacts. Below, we will explain the method of fabrication and the design of contact assemblies 30 using FIG. 4 for depicting a portion thereof.

At the beginning, a plurality of contacts 31 constituting contact assembly 30 are made in the form of a carrier strip in which contacts 31 are attached at one end to carrier 32, at a pitch of 0.5 mm for example. Across contacts 31 attached to the carrier strip, are formed a first strip 33 and a second strip 34 made of a thin insulating material preferably by the known method of insert molding. First strip 33 is relatively narrow, is located near carrier 32 of contacts 31, and is molded so that contacts 31 are embedded approximately in the center of the strip. Relatively wide (for example, about 1.5 mm) second strip 34 is molded at the free ends of contacts 31 constituting sections forming connections with contacts of the mating connector so that the surface of the contact sections 35 is exposed. The middle or intermediate section of the contacts 31 located between the first strip 33 and the second strip 34, is bent to form a U-shaped configuration which straddles side walls 22, 23 of housing 20 as shown in FIG. 1. As one can see from FIGS. 1 and 3, contact assemblies 30 are mounted in such a manner that the second strip 34 is located inside cavity 21 of housing 20, that is, on the inside surfaces of side walls 22, 23 and the first strip 33 is located on the outer surface, and that the exposed contact sections 35 of contacts 31 are facing inside cavity 21 (that is, away from the internal surfaces of side walls 22, 23).

The carrier 32 of contacts 31 of contact assemblies 30 is cut off prior to the their mounting in housing 20. The cut ends of contacts 31 are bent at right angles to form soldering sections 37 which are soldered to the contact pads of the printed circuit board 50. As can be seen from FIG. 3, the intermediate portions 36 of contacts 31 of contact assemblies 30 running along the outer surfaces of side walls 22, 23 do not adjoin the walls but are spaced a small selected distance outwardly therefrom. Instead, they form a gap G therewith, and since contacts 31 are made of a very thin metal sheet, connector 10 can slightly move in the right-to-left direction relative to printed circuit board 50.

Contact assemblies 30 can be fixed to housing 20 by pressing the second strips 34 of contact assemblies 30 into grooves 29 formed on both sides of cavity 21 of housing 20. If necessary, it is possible to form grooves corresponding to positions of each contact on the end surface of side walls 22, 23 of housing 20 (the upper surface in FIG. 1), and contacts 31 with formed barbs can be pressed into such grooves.

The purpose of fasteners 40 is to secure connector 10 to printed circuit board 50 after the soldering sections 37 were joined to the contact pads of the printed circuit board by means of SMT (reflow technique) in order to reinforce its attachment thereto against repetitive insertions and removals. When plug section 112 of mating connector 100 is inserted in cavity 21 of the housing of connector 10 with an excessive force applied to soldering sections 37 of contacts 31 of contact assembly 30, there is danger that the soldering sections 37 become separated from the contact pads of the printed circuit board 50. The function of fasteners 40 is to eliminate or reduce the force generated by the pulling of mating connector 100 from connector 10 to the soldering sections 37 of contacts 31.

Fasteners 40 are fabricated by stamping and bending. As shown in FIG. 1, each fastener 40 consists of a main body 41 extending perpendicularly to the printed circuit board having at the lower end a soldering shoulder 42 which is fixed by soldering to a metal pad made on the printed circuit board. At the upper end is a retaining shoulder 43 holding the housing by pressing on the upper surfaces of mounting openings 27, 28, and a pair of L-shaped arms 44, 45 whose purpose is to secure the fasteners in mounting openings 27, 28.

Due to the above described design, when electrical connector 10 is mounted on the printed circuit board, its housing 20 can move parallel to the printed circuit board but it is prevented from being lifted off the board by fasteners 40. In this embodiment, the lower ends of fasteners 40 are soldered to the pads made on the printed circuit board 50; however, it is not the only method of the mounting. Instead, openings can be made in the printed circuit board 50 and instead of the soldering shoulder 42, a pair of spring-loaded legs can be made similar to the device described in the Japanese Utility Model Disclosure Hei 1 (1989)-42645 that will be pressed in such rectangular openings.

Figure 2:
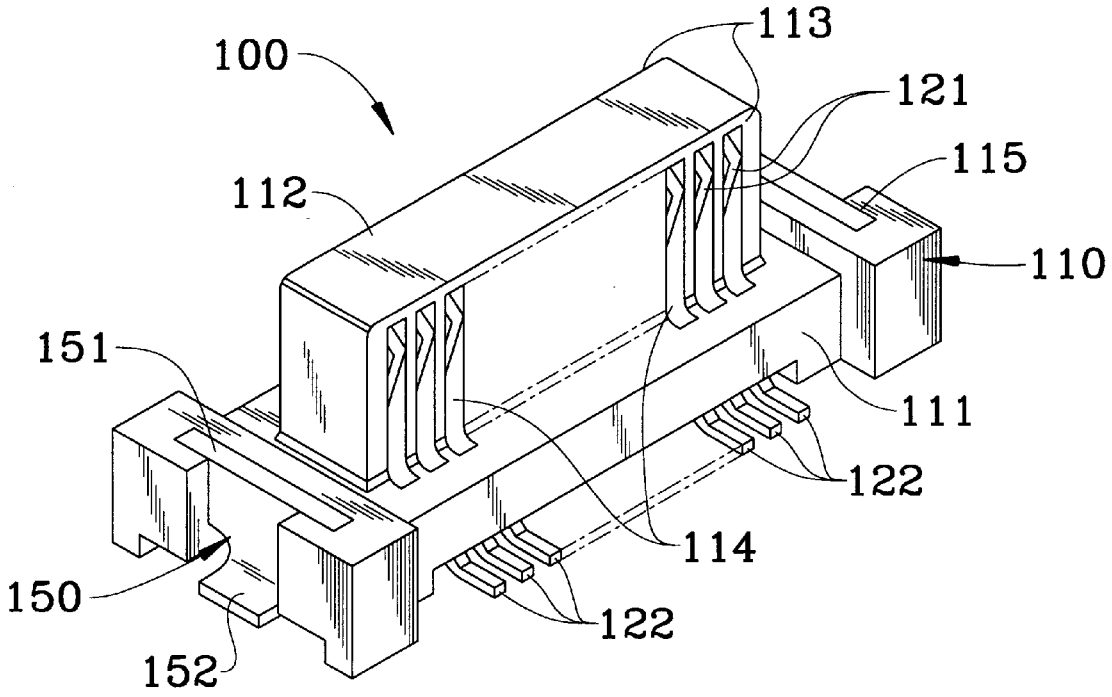
FIG. 2 is an isometric view of a mating connector intended for the engagement with the connector shown in FIG. 1.

Next, we will provide explanations concerning the mating connector 100 used with electrical connector 10 for printed circuit boards with reference to FIG. 2. Connector 100 has an insulating housing 110 consisting of a rectangular base 111 and a plug portion 112 extending upward. At both ends of insulating housing 110, a pair of metal fasteners 150 are pressed in. On both side surfaces 113 of plug portion 112 of housing 110, a number of slots 114 are formed. In slots 114 are arranged two rows of L-shaped contacts 120 each consisting of a contacting section 121 and a soldering section 122. Free ends of contacting sections 121 of contacts 120 are extended outside through the outside surfaces 113 near the front end of plug portion 112 of housing 110.

Fasteners 150 of mating connector 100 shown in FIG. 2 each have a retaining section 151 which is pressed in the groove 115 of housing 110, and a soldering section 152 that is secured on printed circuit board 200 (FIG. 3) by soldering to a pad. Unlike connector 10 shown in FIG. 1, connector 100 is fixed to printed circuit board 200 so that it can not move relative to the board.

FIG. 3 depicts connector 10 shown in FIG. 1 and connector 100 shown in FIG. 2 in a mated state. Contact sections 121 of contacts 120 of mating connector 100 soldered to printed circuit board 200, form a spring-loaded connection with the contact sections 35 of contacts 31 of contact assemblies 30 of connector 10 soldered to printed circuit board 50. As can be seen from FIG. 3, contact sections 112 of two rows of contacts 120 of mating connector 100 are retained in housing 110 so that their backs face the central partition 116. That is, the bases of the contact sections 121 of contacts 120 are against central partition 116, and the cantilevered portions with the contacting point located on the free ends, extend outside away from central partition 116. Resultingly, contact sections 121 of contacts 120 are spring loaded providing contacting pressure necessary for reliable connection between contacts 31 and 121 of connectors 10 and 100.

Due to such a design, it is possible to implement a very narrow spacing of approximately 4 mm between printed circuit boards 50 and 200 joined together by means of connectors 10 and 100, that is, to implement a low profile structure. In addition, since electrical connector 10 can to some degree move in lateral direction relative to printed circuit board 50, printed circuit boards 50 and 200 can be joined together even when there exists some misalignment. The contacts 31, 121 provide for a reliable connection even with this low-profile structure, the mating length can be as short as 1.2 mm.

Figure 5:
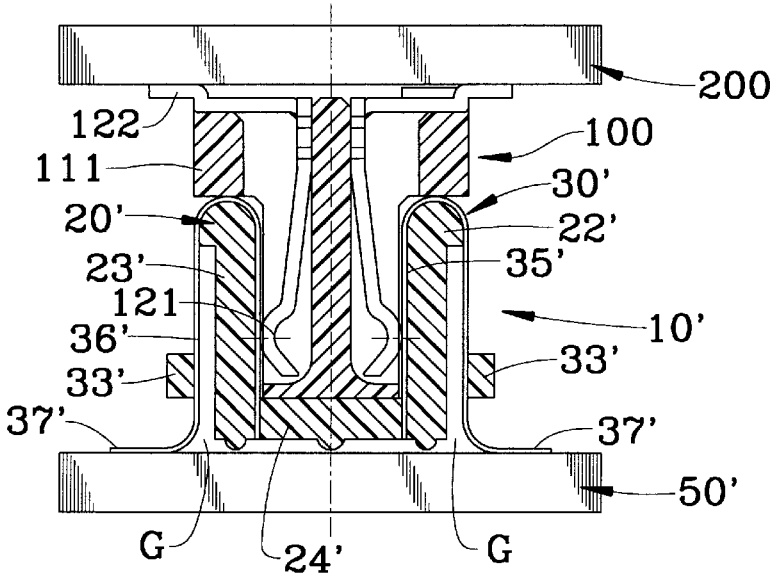
FIG. 5 is a cross section similar to FIG. 3 depicting another embodiment of the electrical connector for printed circuit boards according to this invention.

FIG. 5 depicts another embodiment of an electrical connector for printed circuit boards according to this invention. In this cross sectional drawing (similar to the cross section illustrated in FIG. 3), connector 10' is shown mated with mating connector 100 shown in FIG. 2.

Electrical connector 10' is similar to connector 10 described above, and here we will explain only the features that are different. Insulating housing 20' has side walls 22',23' and bottom 24' forming a box-like structure or a structure with a U-shaped cross section, and in this respect is similar to insulating housing 20. However, the difference is that cavities are made in the lower portions located near the bottom 24' of the outer surfaces of side walls 22',23'.

Contact assemblies 30' are bent to a U-shaped configuration and arranged in two rows, after which they can be secured in insulating housing 20' preferably by insert molding. That is, if in connector 10, the contact assemblies 30 were bent and then mounted to the insulating housing 20, in connector 10' they are molded as an integral part of insulating housing 20'. Contact assemblies 30' are made as a plurality of contacts 31' connected to a carrier (forming a comb-like configuration), placed in the mold and insert molded to form the housing. The carrier is cut off after the molding is accomplished.

The front ends of contacting section 35' of contacts 31' are embedded in the bottom 24' of insulating housing 20' so that the inside surfaces of the contacting sections 35' are exposed to cavity 21'. However, unlike in the contact assembly 30, the contact sections 35' of the contact assembly 30' do not have an insulating strip, but rather they are insert molded in the inside surfaces of side walls 22' and 23' of the insulating housing 20' by inside surfaces of contacts 31'. Soldering sections 37' of contacts 31' are secured at a desired pitch, for example, at 0.5 mm, by a plastic strip 33' made of the same plastic material as the insulating housing 20'.

As it was mentioned above, contacts 31' are fabricated from, for example, 0.05 mm metal sheet and bent to a U-shaped configuration, and cavities are provided on the outer surfaces of side walls 22', 23' of the insulating housing 20'. Therefore, a gap G exists between the outside surface 36' of contact 31' and the outer surfaces of side walls 22', 23' of insulating housing 20'. Resultingly, when electrical connector 10' is secured on printed circuit board 50' by soldering, it can move relative to the board within limits corresponding to the size of gap G.

Strip 33' of contact assembly 30' can be formed by molding before it is molded in insulating housing 20' as its integral part. The size of gap G between the outer surfaces of side walls 22', 23' of insulating housing 20' and the outside surface 36' of contact 31' can be selected freely depending on the degree of movement the designer wants to impart to connector 10'.

Above, we have provided explanations concerning embodiments of the electrical connector for printed circuit boards according to this invention. However, this invention is not limited only to the embodiments described above and various modifications can be made depending on specific applications. For example, necessary strips 33, 33' used for the alignment of contacts in contact assemblies, may be replaced with adhesive tape. Contacting sections of the mating connector contacts can be of a J-shaped configuration to increase their elasticity.

Contacts of the electrical connectors according to this invention are fabricated from extremely thin metal sheet by stamping and bending and are arranged in the insulating housing in such a manner that there is a gap between the contacts and housing side walls making it possible for the connector to move laterally relative to the printed circuit board. This feature compensates for some misalignment with a mating connector and to provide for a reliable engagement. Therefore, these connectors are excellent for joining together two printed circuit boards in small-size high-density electronic equipment.

Another advantage of the electrical connector is that the contacting surface of the contacts is the smooth rolled surface of the metal sheet and the same is true for the contacts of the mating connector, thus providing for a stable highly reliable electrical connection. This also helps to prevent abrasion of gold plating off the contacting sections due to repetitive engagements and disengagements of the connectors.

Another advantage consists in the fact that the contact assembly may be made in the form of a lead frame and can be either fixed to the insulating housing or molded as an integral part thereof, thus making it possible to simplify the manufacturing process and to reduce its cost. Therefore, these connectors are excellent for the use in inexpensive small-size high-density electronic applications such as portable telecommunications devices.

What is claimed is:

1. An electrical connector mountable onto a circuit board, comprising:

an insulative housing having a board-mounting face and an opposed mating face, and having a plurality of contacts secured to said housing each having a board-connecting section intended for connection to an associated pad of said circuit board, an intermediate section, and a contact section for electrical engagement with a complementary contact of a mating connector;

said contacts being stamped from a thin conductive metal sheet and formed into a U-shape between said contact sections and said intermediate sections, and secured to said housing with their U-shape straddling side walls of said housing with said contact sections disposed in a connector-receiving cavity and said intermediate sections disposed freely along outer surfaces of said housing side walls and spaced a small selected distance outwardly therefrom, and said intermediate sections defining opposing arrays extending from said mating face to said board-connecting sections extending past a board-mounting face of said housing; and said intermediate sections being arranged in such a manner that after connection of said board-connecting sections to contact pads of said circuit board, there is a gap between said outer surfaces of said housing and said intermediate sections, permitting the connector to move incrementally between said opposing arrays of said intermediate sections to adjust the position of said housing upon initial engagement with a mating connector at said mating face to permit mating therewith.

2. The electrical connector as set forth in claim 1 wherein said housing is secured to said circuit board by fasteners in openings of mounting flanges thereof that permit limited movement of said housing with respect to said board after said fasteners are secured to said circuit board.

3. The electrical connector as set forth in claim 1 wherein said contact sections of a row thereof are secured together spaced from each other by being insert molded along an inside surface of a said side wall of said housing.

4. The electrical connector as set forth in claim 1 wherein said contact sections of a row thereof are secured together spaced from each other by an insulating strip disposed in said connector-receiving cavity.

5. The electrical connector as set forth in claim 4 wherein said insulating strip is inserted into grooves along end walls of said connector-receiving cavity.

6. The electrical connector as set forth in claim 1 wherein said intermediate sections along a common side of said housing are secured together spaced from each other by an insulating strip spaced from an associated said outer surface of said housing.

7. The electrical connector as set forth in claim 6 wherein said contact sections of a row thereof are secured together by another insulating strip prior to being disposed in said connector-receiving cavity.

8. The electrical connector as set forth in claim 7 wherein said another insulating strip is inserted into grooves along end walls of said connector-receiving cavity.

9. The electrical connector as set forth in claim 6 wherein retention barbs are formed on said contacts between said contact sections and said intermediate sections to be disposed in grooves of end surfaces of said housing side walls at said mating face for contact retention.

10. An electrical connector mountable to a circuit board, comprising:

an insulative housing having a plurality of contacts mountable thereto each having a board-connecting section intended for connection to an associated pad of said circuit board, an intermediate section, and a contact section disposed in a connector-receiving cavity for electrical engagement with a complementary contact of a mating connector; and said contacts being secured together in single-row arrays by insulating strips located near both ends of contacts of each array and their intermediate sections between said insulating strips being bent to a U-shaped configuration to straddle side walls of said housing and upon being mounted into said housing said intermediate sections are spaced a small selected distance outwardly from outer surfaces of said side walls to provide for a certain degree of movement relative to said circuit board after said board-connecting sections are secured to said associated pads of said circuit board.

11. The electrical connector as set forth in claim 10 wherein retention barbs are formed on said intermediate portions of said contacts to be disposed in grooves of end surfaces of said housing side walls adjacent an entrance to said connector-receiving cavity, for contact retention.

12. The electrical connector as set forth in claim 10 wherein one of said insulating strips is inserted into grooves along end walls of said connector-receiving cavity.

* * * * *